United States Patent [19]

Miwa et al.

[11] 4,430,412

[45] Feb. 7, 1984

[54] METHOD AND APPARATUS FOR TRANSFERRING AND FIXING TONER IMAGE USING CONTROLLED HEAT

[75] Inventors: Tadashi Miwa, Kunitachi; Kiyoshi Kimura, Iruma; Yukiharu Komiya; Noriyoshi Tarumi, both of Hachioji, all of Japan

[73] Assignee: Konishiroku Photo Industry Co., Ltd., Tokyo, Japan

[21] Appl. No.: 439,426

[22] Filed: Nov. 5, 1982

[30] Foreign Application Priority Data

| | | | |
|---|---|---|---|
| Nov. 13, 1981 | [JP] | Japan | 56-181195 |
| Nov. 16, 1981 | [JP] | Japan | 56-182292 |
| Nov. 16, 1981 | [JP] | Japan | 56-182293 |

[51] Int. Cl.[3] ..... G03G 13/14; G03G 13/20

[52] U.S. Cl. ..... 430/126; 118/641; 118/60

[58] Field of Search ..... 430/126; 118/641, 60

[56] References Cited

U.S. PATENT DOCUMENTS

| | | | |
|---|---|---|---|
| 3,374,769 | 3/1968 | Carlson | 118/641 |
| 3,592,642 | 7/1971 | Kaupp | 430/126 |
| 3,893,761 | 7/1975 | Buchan et al. | 430/126 X |

*Primary Examiner*—John D. Welsh

*Attorney, Agent, or Firm*—Jordan B. Bierman; Linda Bierman

[57] ABSTRACT

A method and apparatus for transferring and fixing toner image wherein a toner image is transferred and fixed onto a transfer material from a toner image retainer through an intermediate transfer member. The toner image on the intermediate transfer member is heated at a temperature lower than the toner fusion temperature, and the transfer material is heated to the toner fusion temperature or over. A pressing unit to press the transfer material onto the intermediate transfer member is heated at the toner fusion temperature or over.

45 Claims, 12 Drawing Figures

METHOD AND APPARATUS FOR TRANSFERRING AND FIXING TONER IMAGE USING CONTROLLED HEAT

BACKGROUND OF THE INVENTION

1. Field of the Invention

This invention relates to an improvement of method and apparatus for transferring and fixing a toner image by means of an intermediate transfer member.

2. Description of the Prior Art

Generally in a picture recording apparatus provided with an intermediate transfer member, a toner image on a toner image retainer which is formed from having a latent image developed by a developing toner is transferred onto the intermediate transfer member in endless belt or roll, and then the toner image once transferred onto the intermediate transfer member is retransferred further onto a transfer material or transfer paper or the like and fixed to a picture. According to such apparatus, not only a high grade of picture can be obtained but also a system to record a multitude of the same pictures by utilizing the latent image once formed more than one time through repeating development and transfer, or the so-called retention system can be introduced, thus facilitating a high-speed operation for picture recording. In addition, the image can be transferred onto a transfer material consisting of an ordinary paper even from using a single component conductive toner as a developing toner, therefore a developing system can be simplified and a picture quality can be improved to an advantage.

Then, various severe conditions may prevail for the concurrence of fixation with transferring the toner image on the intermediate transfer member onto the transfer material, therefore it is considerably difficult to attain transfer and fixation of a quality toner image at the same time.

As described in Japanese Patent Publication No. 41,679/1971, for example, hitherto known is such a means as will heat a transfer material without heating a toner of the toner image on an intermediate transfer member and thus transfer and fix the toner image with a heat of the transfer material.

This means is preferable as far as the intermediate transfer member will be kept from overheating and hence a thermal influence will be prevented from exerting on a toner image retainer, however, an availability of the heat is low, and thus a considerable quantity of thermal energy must be applied onto the transfer material consisting of an ordinary paper. Moreover, a thermal energy to be applied on the transfer material is different in quantity according to the kind of transfer material normally consisting of a paper, the thermal energy is necessary in large quantities for the transfer material consisting of a paper weighty or porous accordingly, the thermal energy equivalent thereto which is given to the transfer material consisting of a paper light or thin may invite overheating to a deformation or a burnt hole of the transfer material in consequence, and therefore the thermal energy to feed must be adjusted according to the kind of transfer material to attain transfer and fixation in good condition. Further, when transfer and fixation of the toner image are carried out at high speed, a large quantity of the thermal energy will have to be given to the transfer material further more, a consumption energy increases as a result, and when the transfer material is not carried smoothly to cause a jam, there may result a firing in most cases.

As described in Japanese Patent Laid Open No. 78,559/1974, on the other hand, such means is also well known as will transfer a toner image on the intermediate transfer member onto the transfer material to fixation by heating a toner of the toner image on the intermediate transfer member up to the fusion temperature without heating the transfer material However, the transfer material deprives the toner much of heat in this means, therefore a fluidity of the toner on the side in contact with the transfer material deteriorates to make it unlikely that the image can be fixed securely, and thus the intermediate transfer member must be heated considerably high in practice. The toner image retainer is unavoidably heated through the intermediate transfer member as a result, and where the toner image retainer is an electrophotographic sensitive member, a density of the picture image deteriorates due to initial potential drop, a material component of the intermediate transfer member sticks to the surface of the toner image retainer to cause fogging, a deterioration of the intermediate transfer member is accelerated, and thus a durability cannot be secured.

To settle such problem, it is conceivable that the intermediate transfer member be cooled down in a moving passage domain after transfer and fixation, however, energy will be consumed furthermore for forced cooling, and the moving passage required for coming in contact with the toner image retainer must be extended further for natural cooling, which may enlarge the apparatus in construction accordingly.

As already described, the toner at the time of transfer and fixation has the side in contact with the transfer material cooled down antecedently to deteriorate in the fluidity, therefore the toner does not transit completely to the transfer material and remains partly on the intermediate transfer member as sticking to stain the toner image retainer and also to give rise to an offset phenomenon.

SUMMARY OF THE INVENTION

This invention has been done on the circumstances mentioned above, and an object is to provide a method and apparatus for transferring and fixing a toner image whereby the toner image on a toner image retainer can be securely transferred onto a transfer material to fixation by means of an intermediate transfer member, an offset phenomenon can be prevented from occurring in consequence, a picture high in resolution and grade can be recorded even according to the retention system, a toner component material can be selected extensively, a necessary consumption energy can be minimized, and further the apparatus can be constituted compactly.

The above object of this invention can be attained by a method for transferring and fixing a toner image comprising the steps of transferring the toner image onto an intermediate transfer member from a toner image retainer and then retransferring it onto a transfer material from the intermediate transfer member to fixation, which is characterized in that the toner image on the intermediate transfer member is heated at a temperature lower than fusion temperature of the toner, a pressure roller to press the transfer material onto the intermediate transfer member is heated at fusion temperature or over of the toner, and the transfer material heated at fusion temperature or over of the toner as above is then fed into transferring and fixing positions, thereby transferring and fixing the toner image onto the transfer material; and also by an apparatus for transferring and fixing a toner image by transferring the toner image from a toner image retainer to an intermediate transfer member and retransferring it from the intermediate transfer member to a transfer material to fixation, which comprises means to heat the toner image on the intermediate transfer member at a temperature lower than fusion temperature of the toner, heating means to heat a pressure roller for pressing the transfer material onto the intermediate transfer member at fusion temperature or over of the toner, and heating means to heat the transfer material at fusion temperature or over of the toner, and means for feeding the transfer material into transferring and fixing positions.

The above-mentioned object of this invention can also be attained by a method for transferring and fixing a toner image comprising the steps of transferring the toner image from a toner image retainer to an intermediate transfer member and then retransferring it onto a transfer material from the intermediate transfer member to fixation, which is characterized in that the toner image on the intermediate transfer member is heated to a temperature lower than fusion temperature of the toner, a pressure roller to press the transfer material onto the intermediate transfer member at a temperature lower than fusion temperature of the toner, the transfer material heated at fusion temperature or over of the toner is fed into transferring and fixing positions, thereby transferring and fixing the toner image on the transfer material; and by an apparatus for transferring and fixing a toner image by transferring the toner image from a toner image retainer to an intermediate transfer member and retransferring it from the intermediate transfer member to a transfer material to fixation, which comprises means to heat the toner image on the intermediate transfer member at a temperature lower than fusion temperature of the toner, heating means to heat a pressure roller for pressing the transfer material onto the intermediate transfer member at a temperature lower than fusion temperature of the toner, and means to heat the transfer material at fusion temperature or over of the toner before pressing it onto the intermediate transfer member.

Further, the above-mentioned object of this invention can be attained by a method for transferring and fixing a toner image comprising the steps of transferring the toner image from a toner image retainer to an intermediate transfer member and then retransferring it onto a transfer material from the intermediate transfer member to fixation, which is characterized in that a transfer material kept at a temperature lower than fusion temperature of the toner is pressed onto the toner image on an intermediate transfer member kept at a temperature lower than fusion temperature of the toner with a pressure roller heated at a temperature higher than fusion temperature of the toner, thereby transferring and fixing the toner image onto the transfer material; and by an apparatus for transferring and fixing a toner image by transferring the toner image from a toner image retainer to an intermediate transfer member and retransferring it from the intermediate transfer member to a transfer material to fixation, which comprises an intermediate transfer member kept at a temperature lower than fusion temperature of the toner, a heat pressure roller heated at fusion temperature or over of the toner which presses the transfer material onto the intermediate transfer member, and means for feeding the transfer material into a position where it is pressed onto the intermediate transfer member at a temperature lower than fusion temperature of the toner.

In the invention, a value obtained on a polymer chemistry flow tester (manufactured by Shimadzu Seisakusho Ltd.) works as a reference for fusion temperature of the toner. Namely, a measurement is made on the flow tester under the conditions of a load being 20 kg/cm$^2$, a nozzle dia. being 1 mm, a nozzle length being 1 mm and a temperature rise rate being 6° C./min., and when the rate of plunger descent is represented by h, a temperature at the point in time of descending by h/10 is taken to be the toner fusion temperature. A toner 1 cm$^3$ in quantity is used as sample for the measurement.

Other object and feature of this invention will be clarified in the course of the following description of the drawings.

DESCRIPTION OF THE PREFERRED EMBODIMENTS

The invention will now be described with reference to the accompanying drawings.

Figure 1:
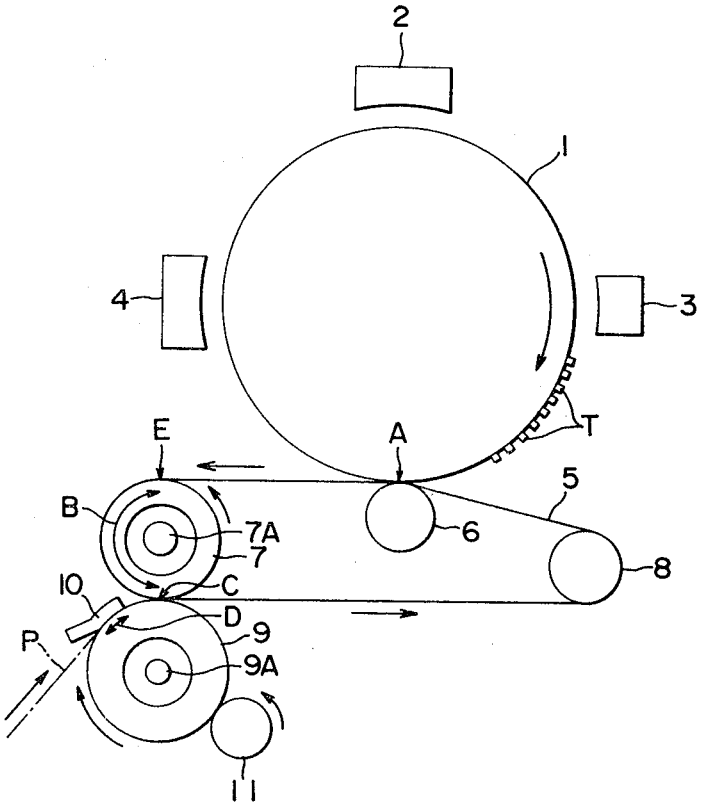
FIG. 1 is an explanatory drawing representing a constitution of an apparatus given in one example of this invention.

FIG. 1 is an explanatory drawing of one example of this invention, wherein a latent image forming mechanism 2, a developing mechanism 3 and a cleaning mechanism 4 are provided in that order in the direction of rotation in a domain along the outer periphery of a rotary drum type toner image retainer 1, and in a transfer domain A between the developing mechanism 3 and the cleaning mechanism 4, an intermediate transfer member 5 consisting of an endless belt is pressed onto the outer periphery of the toner image retainer 1 with a pressure roller 6. The intermediate transfer member 5 is suspended on a heat roller 7 and a tension roller 8 besides the pressure roller 6, moved at a uniform speed with the toner image retainer 1 in the same direction and is thus directed to an intermediate transfer member heating domain B in the heat roller 7.

At a parting point of the intermediate transfer member 5 in the heat roller 7 or a transfer fixation domain C in the neighborhood thereof, there is provided a heat pressure roller 9 to feed the intermediate transfer member 5 and a transfer material consisting normally of a transfer paper with the heat roller 7, and also there is provided a transfer material heating plate 10 to prepare a transfer material heating domain D along a transfer material moving passage P immediately before the transfer material is put between the heat roller 7 and the heat pressure roller 9.

In an apparatus of the above constitution, a toner image T formed on the toner image retainer 1 is transferred onto the transfer material to fixation finally as follows:

The toner image T on the toner image retainer 1 is formed by developing a latent image formed on the latent image forming mechanism 2 on the developing mechanism 3. Namely, in the case of electronic photography, the toner image retainer 1 is constituted of a binder type in selenium, organic compound, zinc oxide or cadmium sulfide or other electrophotographic sensitive member, the outer periphery of the toner image retainer 1 is charged thoroughly by the latent image forming mechanism 2 and then subjected to a picture image exposure to form an electrostatic latent image. Then in the case of electrostatic recording, the toner image retainer 1 is constituted of a dielectric consisting of a conductive base material and a dielectric surface layer, and a latent image is formed by converting a picture image signal into an electrostatic latent image through a multistylus electrode or an ion control electrode. In the case of magnetic recording, the toner image retainer 1 is constituted of a magnetic substance, and a magnetic latent image can be formed through converting the picture image signal into a magnetic signal on a magnetizing head.

When the latent image thus formed is electrostatic, it is processed to a visible image with a toner which is a colored charge particle charged to a polarity counter to the charge forming the latent image on the developing mechanism 3. In case the toner used here is a single component conductive magnetic toner, the image is developed with a charge induced on the toner. When the single component conductive magnetic toner is used and a magnetic brush developing process is applied therefore, a toner layer is formed in a single particle layer or a thin layer approximate thereto, therefore the picture image obtained finally is superior in quality, durability and high-speed developing efficiency and the image can be transferred in good condition without selecting the transfer material particularly therefore. When the latent image is a magnetic latent image, the development is available by a magnetic toner, and a bleeding of the picture is prevented from occurring at the time of transfer, thus obtaining a distinct picture.

The toner image T formed as above on the toner image retainer is transferred onto the intermediate transfer member 5 in the transfer domain A with a pressure of the pressure roller 6.

The intermediate transfer member 5 is formed with a laminate of a transfer layer consisting of a heat resisting elastic body like silicone rubber or fluororubber and a heat resisting high molecular film like heat resisting film ("U Sheet" manufactured by Taihei Kagaku, for example) of a heat resisting base material like stainless steel plate, for example, and resins such as polyimide, polyimideamide, polyamide, polyester, polyallylate, and room temperature vulcanized or low temperature vulcanized silicone rubber is particularly preferable for material of the transfer layer. For example, "LTV 1300" and "LTV 1800" (manufactured by Shinetsu Chemical Industry Co., Ltd. both) are addition polymer silicone rubbers, which are preferable particularly for material of the transfer layer. These silicone rubber layers are capable of seizing the toner thoroughly on the intermediate transfer member side through prevailing against a toner retention force of the toner image retainer 1 in the transfer domain A at low temperature with a moderate tackiness on the surface and a rubber elasticity including the toner, and on the other hand, the surface energy is reasonably small as compared with an ordinary transfer material, therefore, when the toner is heated and thus fluidized from the surface on the transfer material side of the toner to press the transfer material, the toner comes to stick strongly to the transfer material and is transferred and fixed almost completely onto the transfer material. Then, the toner image T and the intermediate transfer member 5 are preferably heated on the heat roller 7, therefore a film thickness of the transfer layer and the base material is preferable as small as possible as far as it has an expected performance, and thus it is optimal that the thickness of the transfer layer come in 10–500 microns and that of the base material in 10–500 microns, for example.

For the intermediate transfer member, which is not necessarily limited to an endless belt, it is acceptable that the transfer layer be provided on the surface of an aluminum or stainless steel hollow roller and a heater be provided within the hollow roller. From using such intermediate transfer member, a toner image transferring and fixing apparatus can be miniaturized more reasonably than in case a belt is used.

The illustrated heat roller 7 is that of having a heater 7A consisting, for example, of an infrared lamp incorporated in a hollow aluminum metallic roller, the surface of the metallic roller is controlled to a temperature coming in a suitable range, thereby heating the intermediate transfer member 5 consisting of an endless belt and the toner image T thereon at a temperature lower than fusion temperature of the toner in a domain between a starting point E for contact with the intermediate transfer member 5 consisting of an endless belt and the transfer fixation domain C, i.e. the intermediate transfer member heating domain B. In this case, a heat resisting elastic layer consisting of silicone rubber or the like can be provided on the surface of the heat roller 7.

As described above, the temperature of the intermediate transfer member 5 is preferable to be as low as possible, subject to allowing transfer and fixation satisfactorily on the transfer material in the transfer fixation domain C. The reason is that when the temperature of the intermediate transfer member 5 becomes high, the toner image retainer 1 is heated on a heat of the intermediate transfer member 5 in the transfer domain A to deteriorate the toner image retainer 1 for the performance characteristic at low temperatures, and the picture comes to deteriorate for a material component of the toner or the intermediate transfer member 5 transferring onto the toner image retainer 1. Therefore, if the temperature of the intermediate transfer member 5 becomes high, a forced cooling must be effected, as hitherto, before the transfer domain A.

A hollow metallic roller of aluminum or the like or that for which a heater 9A consisting of an infrared lamp, for example, is incorporated in the hollow interior provided with a heat resisting elastic material surface layer of silicone rubber is used for the heat pressure roller 9 in the transfer fixation domain C; the heater 9A is properly controlled, thereby setting the surface temperature of the heat pressure roller 9 at a temperature lower than the toner fusion temperature of the toner image, and preferably higher than temperature of the intermediate transfer member.

Then, the illustrated transfer material heating plate 10 has a shape so as to come in contact with the heat pressure roller 9 along its outer periphery, which operates to heat the transfer material at a temperature higher than fusion temperature of the toner along with the heat pressure roller 9 when it passes between the surface of the heat pressure roller 9 and the transfer material heating plate 10. The toner image on the intermediate transfer member 5 is thus transferred and fixed thoroughly onto the transfer material in the transfer fixation domain C. Here, a friction coefficient of the surface of the heat pressure roller 9 is kept larger than that of the surface of the transfer material heating plate 10. This may allow the transfer material to move in accordance with a move of the surface by rotation of the heat pressure roller 9, and if the transfer material is arranged to move in contact with the surface of the fixed transfer material heating plate 10 for better heating efficiency, it can also be carried smoothly to the transfer fixation domain C. The transfer material heated as above comes to overlap the intermediate transfer member 5 heated together with the toner image beforehand by the heat roller 7 in the transfer fixation domain C, and since the overlap is compressed by the heat roller 7 and the heat pressure roller 9 heated at toner fusion temperature or over of the toner image, the toner image is fused by a heat from the transfer material at least at the side on which the toner comes in contact with the transfer material, and the toner image on the intermediate transfer member 5 is then securely transferred and fixed onto the transfer material with furtherance of the compression.

As mentioned above, when the transfer material is contacted with the surface of the transfer material heating plate 10, it is important that the friction coefficient of the transfer material heating plate 10 with the transfer material be minimized, therefore it is effective to smoothen the surface of the transfer material heating plate 10 or apply coating with a material of low friction coefficient like fluororesin thereon. For example, a coating of resins such as polytetrafluoroethylene, perfluoroalkoxide, polyfluoroethylene propylene or that for which metallic powder, inorganic oxide, etc. are mixed and dispersed in those resins, or "LURON" (manufactured by Dinox) on a material of aluminum, stainless steel, etc. or an impregnation of a porous material treated with hard almite with Teflon may bring a satisfactory result in strength of wear resistance and low friction coefficient. Then, the above treating of coating or impregnation is also superior in keeping the surface energy low and preventing a toner stain from depositing further, a metallic plate having mirror finished surface by hard chrome plating is a preferable material, too. A heater for the transfer material heating plate 10 will preferably be finished in plate, and PCT plate consisting of resistance heating element having a positive temperature characteristic requires no temperature control particularly therefore, which is advantageous in respect of electric energy.

It is preferable that a heating surface of the transfer material heating plate 10 comes in contact with the transfer material as mentioned, however, it can be arranged to come in contact partly with the surface of the transfer material. Then the state wherein it is kept close extremely may result in obtaining a satisfactory heating effect. In this case, an interval with the transfer material surface is kept at 3 mm or below normally. It is also effective to heat the transfer material by providing a pinch roller system using a heat roller before the transfer fixation domain C.

The transfer material having passed the transfer fixation domain C is carried along the intermediate transfer member 5 normally and detached from the intermediate transfer member 5 at the tension roller 8. Here, by minimizing the diameter of the tension roller 8, the transfer material can be detached from the intermediate transfer member 5 more easily, and further by oscillating it, the intermediate transfer member 5 consisting of an endless belt can be prevented also from biasing.

The intermediate transfer member 5 having passed the transfer fixation domain C is cooled down naturally subjected to transfer operation again at the transfer domain A and then repeats the process of transfer and fixation further in the transfer fixation domain C.

In the drawings, a reference numeral 11 denotes a cleaning roller, which operates for removing the toner sticking, if any, on the heat pressure roller 9.

As described above, in this invention, the toner of a toner image on the intermediate transfer member 5 which is transferred from the toner image retainer 1 is heated, together with the intermediate transfer member 5 on which it is supported, at a temperature lower than fusion temperature of the toner, the transfer material is heated at the fusion temperature or over, and thus the intermediate transfer member 5 and the transfer material are pressed each other, therefore the toner image can be transferred and fixed onto the transfer material without disturbing its state.

Namely, in the intermediate transfer member heating domain B, since the toner which forms the toner image is only heated to a temperature whereat the state of solid or that in which it is deformed under pressures is still retained, the toner image arriving at the transfer fixation domain C is kept transferred from the toner image retainer 1 and no disturbance will result in a picture due to the toner being fluidized, and further the toner kept in such state is pressed with the transfer material in the transfer fixation domain C. And the toner temperature rises by a heat from the transfer material and the heat pressure roller 9 from the side whereat it comes in contact with the transfer material to fusion, and further it is deformed on a press force to bind onto the transfer material, therefore the toner will not be destroyed to bleeding, and thus transferred and fixed securely as holding a high resolution. Moreover, since the toner is kept in a solid or high viscosity, an offset phenomenon is prevented thoroughly from occurring.

Then, a heating efficiency of the transfer material by the transfer material heating plate 10 will deteriorate by heating it to a high temperature, for example, at 100° C. or over. Therefore, it is preferable that the transfer material will be heated by the transfer material heating plate 10 only to a temperature somewhat higher than the toner fusion temperature of the toner image and then pressed onto the intermediate transfer member 5 by the heat pressure roller 9 which is heated at the toner fusion temperature or over. The transfer material temperature is kept efficiently at the toner fusion temperature or over consequently, and an interfacial temperature between the transfer material and the intermediate transfer member 5 and the toner temperature of the toner image rise, thus securing stable transfer and fixation as described above.

On the other hand, an arrangement is such that the intermediate transfer member 5 and its toner image, the transfer material and the heat pressure roller 9 are heated all at the same time as mentioned, therefore each necessary heating temperature can be kept lower, an excessive heating of each of them is not required, the quantity of heat escaping can be suppressed at minimum, an overall thermal availability can thus sharply be improved, and also a total consumption energy can be decreased substantially. Then, the toner image can be transferred and fixed at high speed.

As already described, furthermore, the temperature of the intermediate transfer member 5 having passed the transfer fixation domain C can particularly be retained low, the intermediate transfer member 5 is cooled down thoroughly on natural radiation without requiring forced cooling therefor, and if the toner image retainer 1 is that of having a fine property against heat in the fundamental characteristic like a photoconductive sensitive member, its characteristic will not be hindered, or a sticking of a part of a material component of the intermediate transfer member 5 onto the toner image retainer 1 can be prevented, the intermediate transfer member 5 is not heated to a high temperature and also not exposed to a severe temperature change to secure its durability for a long period of time, or the condition of heat resistance necessary for the material of the intermediate transfer member 5 is moderated, and thus the material can be selected extensively to lower the cost. In this invention, however, a forced cooling of the intermediate transfer member 5 and the toner image retainer 1 is not prohibited. And, since the toner is fixed as already described, the toner image is detached from the intermediate transfer member 5 almost completely in the transfer fixation domain C, therefore the toner will not remain on the intermediate transfer member 5 after transfer and fixation, thus preventing the toner image retainer 1 from being stained and an offset phenomenon from occurring.

Figure 2A:
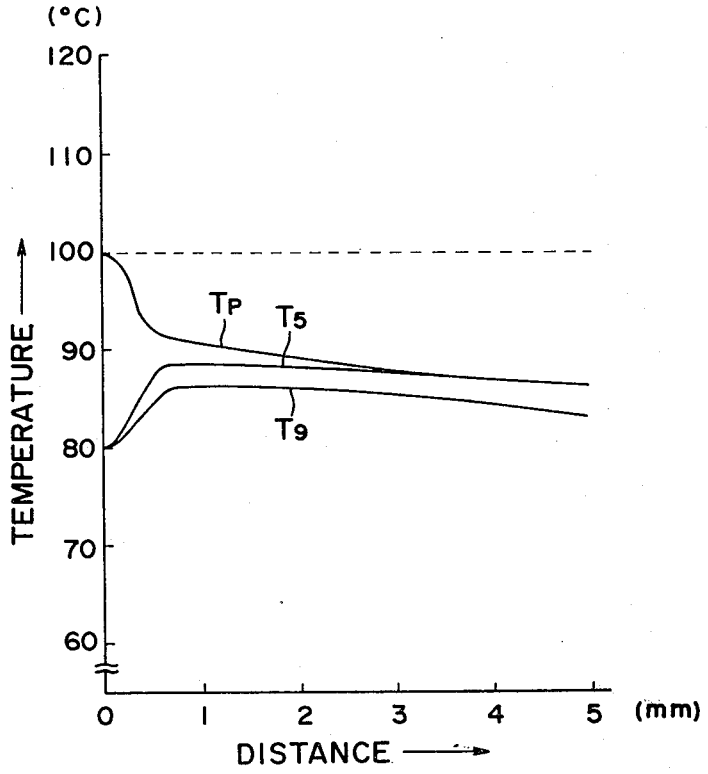
FIGS. 2A, 2B, 2C, 3A, 3B and 3C are curves indicating a temperature change of an intermediate transfer member having a toner image and a transfer material in the example of FIG. 1.
Figure 3A:
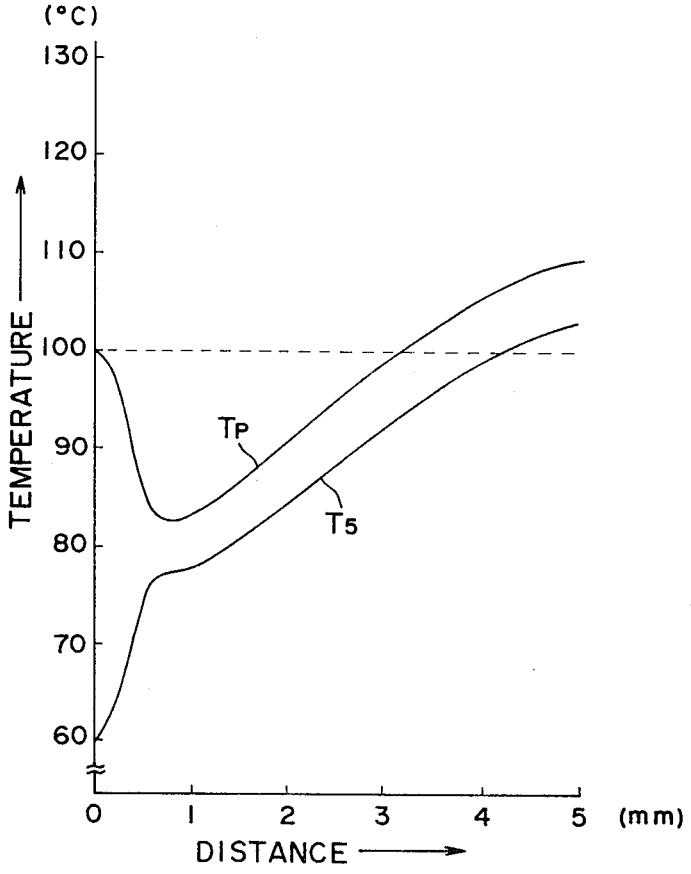

FIGS. 2A and 3A represent a change in an upper surface temperature $T_5$ of the intermediate transfer member 5 in the neighborhood of a spot whereat the heat roller 7 and the heat pressure roller 9 come to press and a transfer surface temperature $T_P$ of the transfer material and further a surface temperature $T_9$ of the heat pressure roller 9 in case, in the apparatus of FIG. 1, the surface temperature of the heat pressure roller 9 is set to be lower than the upper surface temperature of the intermediate transfer member 5 and also set to be higher than the toner fusion temperature of the toner image to say nothing of the upper surface temperature of the intermediate transfer member 5. Then, the quadrature axis indicates a distance taken in the direction of rotation of both rollers from the position O immediately before the spot whereat the heat roller 7 and the heat pressure roller 9 come to press.

In case the surface temperature of the heat pressure roller 9 is set to be lower than the upper surface temperature of the intermediate transfer member 5, if the transfer surface temperature $T_P$ of the transfer material immediately before it comes into the spot whereat the heat roller 7 and the heat pressure roller 9 come to press is kept at the toner fusion temperature or over of the toner image by the transfer material heating plate 10, the transfer surface temperature $T_P$ of the transfer material suddenly drops, as shown in FIG. 2A, because a thermal capacity of the transfer material is small, the upper surface temperature of the intermediate transfer member 5, or the toner image temperature will never come at the toner fusion temperature or over, and hence the toner image will not be transferred and fixed onto the transfer material. In this case, as will be apparent from the temperature changes $T_P$, $T_5$, $T_9$ of FIG. 2A, a cooling effect is given to the transfer material and the intermediate transfer member 5 by the heat pressure roller 9. In case, then, the surface temperature of the heat pressure roller 9 is set to be higher than the toner fusion temperature, even if the transfer surface temperature $T_P$ of the transfer material drops once, it rises immediately again as shown in FIG. 3A, the upper surface temperature $T_5$ of the intermediate transfer member 5 rises to the toner fusion temperature or over consequently, and thus the toner image is transferred and fixed onto the transfer material as described in the transfer fixation domain C.

Figure 4:
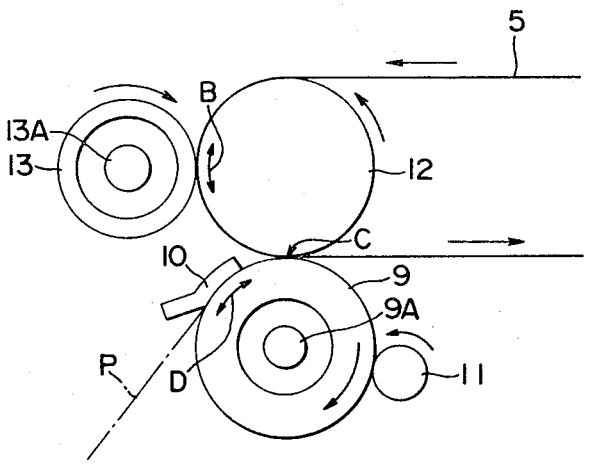
FIG. 4 is an enlarged view of a main part of the apparatus given in another example of this invention.

In the first operative example described as above, the intermediate transfer member 5 constituted in an endless belt and the toner image transferred thereto are heated by a conduction heat from the heat roller 7 in contact with the intermediate transfer member 5 to support, which is taken preferable for efficiency of the thermal application. Then in this case, it is desirable that the intermediate transfer member 5 be contacted and heated at 90 degrees or over of the center angle of the heat roller 7. By preparing the intermediate transfer member heating domain B large enough as above, the state wherein temperatures of the intermediate transfer member 5 and the heat roller 7 are almost balanced is obtained when it reaches the transfer fixation domain C the temperature of the toner on the intermediate transfer member 5 immediately before coming into the transfer fixation domain C can be controlled at high precision to stable transfer and fixation, and by selecting that with a small diameter for the heat roller 7, the apparatus can also be miniaturized To heat the intermediate transfer member 5 and the toner of the toner image, the heat roller 7 is replaced with an ordinary roller 12 as shown in FIG. 4, and a heat roller 13 having a heater 13A can be provided rotatably in contact therewith. It is then preferable that the surface layer of the heat roller 13 be formed with a fluororubber or silicone rubber to have a mold releasability. In this case, a contact width of the roller 12 and the heat roller 13 will be taken preferably large therefor.

In the second operative example of this invention, the heater 9A is controlled suitably for heat generation, and thus the surface temperature of the heat pressure roller 9 is retained at the toner fusion temperature or below of the toner image and preferably at the upper surface temperature or over of the intermediate transfer member 5.

In this example, the toner image to come into the transfer fixation domain C is heated up to a suitable temperature of the toner fusion temperature or below beforehand, therefore a thermal nonefficiency due to heating the transfer material at high temperature like the method disclosed in Japanese patent Publication No. 41,679/1971 cited hereinabove can reasonably be prevented.

As the surface temperature of the heat pressure roller 9 is retained at the toner fusion temperature or below the toner image on the intermediate transfer member 5 is cooled to a temperature around the toner fusion temperature or below which is heated up to the toner fusion temperature or over once by a heat from the transfer material with a temperature higher than the toner fusion temperature in the transfer fixation domain C and thus bonded securely to the transfer material. The toner image therefore comes out of the transfer fixation domain C after it is fixed thoroughly, and an offset phenomenon will never occur consequently. This may be effective to materialize the use of such toner acute in softening characteristic as will deteriorate suddently in viscosity against temperature rise, and further where the intermediate transfer member 5 deteriorates to have the upper surface roughened and thus a bond strength of the toner image increases, a transfer onto the transfer material can be effected stably and perfectly thereby.

In particullar, to keep the surface temperature of the heat pressure roller 9 between the upper surface temperature of the intermediate transfer member 5 and the toner fusion temperature, i.e. at a temperature almost equal to the upper surface temperature of the intermediate transfer member 5 practically is available to keeping a stable temperature easily on a simple controlling means and also to preventing the temperature of the intermediate transfer member 5 from rising as in the case wherein the heat pressure roller 9 is set at the toner fusion temperature or over.

Furthermore, an arrangement that the transfer material heating plate 10 is retained at a level higher than the toner fusion temperature and the intermediate transfer member 5 and the heat pressure roller 9 are retained at a level lower than the toner fusion temperature on the other hand is effective to separate a high temperature zone and a low temperature zone in the apparatus, and thus a high temperature heat source can be concentrated to minimize a diffusion of the heat into the atmosphere.

Figure 2B:
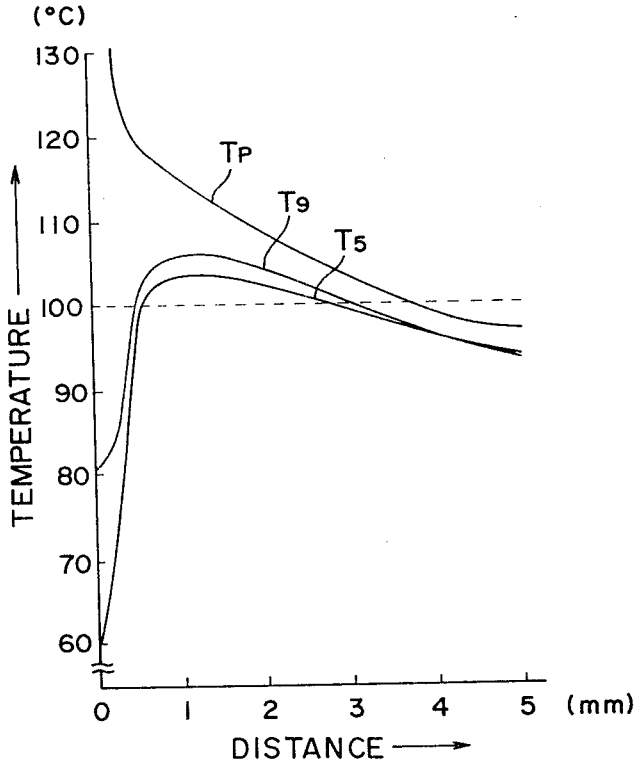
Figure 3B:
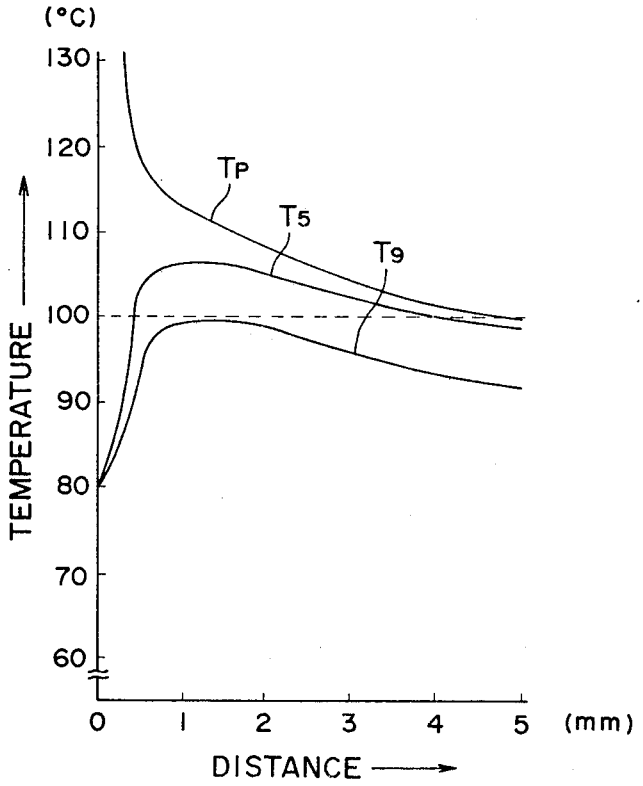

FIGS. 2B and 3B represent a change in the upper surface temperature of the intermediate transfer member 5 in the neighborhood of a spot whereat the heat roller 7 and the heat pressure roller 9 come to press and the temperature $T_5$ of the toner image, the transfer surface temperature $T_P$ of the transfer material and the surface temperature $T_9$ of the heat pressure roller 9 in the apparatus given in FIG. 1, the quadrature axis indicating a distance taken in the direction of rotation of both rollers from the position O immediately before the spot whereat the heat roller 7 and the heat pressure roller 9 come to press. Then, FIG. 2B represents the case wherein the temperature of the heat roller 7 is controlled so as to have the upper surface temperature $T_5$ of the intermediate transfer member 5 at 60° C., and the surface temperature $T_9$ of the heat pressure roller 9 at 80° C., and the heating surface temperature of the transfer material heating plate 10 is controlled at 160° C.; FIG. 3B represents the case wherein the upper surface temperature $T_5$ of the intermediate transfer member 5 and the surface temperature $T_9$ of the heat pressure roller 9 are controlled at 80° C. both, and the heating surface temperature of the transfer material heating plate 10 is controlled at 140° C. Then in both cases, the toner fusion temperature is given at 100° C. or so. As will be apparent from FIGS. 2B and 3B, even in case the upper surface temperature $T_5$ of the intermediate transfer member 5 is set low, from increasing the transfer surface temperature $T_P$ on the transfer material heating plate 10 accordingly, the upper surface temperature $T_5$ of the intermediate transfer member 5 exceeds the toner fusion temperature satisfactorily when reaching the spot whereat the heat roller 7 and the heat pressure roller 9 come to press, the toner of the toner image on the intermediate transfer member 5 is fused consequently, and thus it is transferred and fixed onto the transfer material. Further, in the case of both FIGS. 2B and 3B, when the toner image passes the spot whereat the heat roller 7 and the heat pressure roller 9 come to press, the transfer surface temperature $T_P$ of the transfer material and the upper surface temperature $T_5$ of the intermediate transfer member 5 become the toner fusion temperature or below, therefore an offset phenomenon on the toner image can be prevented.

As described above, according to the second operative example of this invention, the temperature of the intermediate transfer member 5 having passed the transfer fixation domain C can be retained low, the intermediate transfer member 5 can be cooled down thoroughly on a natural radiation without requiring a forced cooling particularly therefor, and even if the toner image retainer 1 is that of having a fine property against heat in its fundamental characteristic like a photoconductive sensitive member, its superior characteristic will not be spoiled thereby, or a sticking of a part of the material component of the intermediate transfer member 5 to the toner image retainer 1 can be prevented, the intermediate transfer member 5 is not heated to high temperature or not exposed to a severe temperature change to ensure the durability for a long period of time, or the condition of heat resistance which is required for the material of the intermediate transfer member 5 is relieved, and the material can be selected extensively to lower the cost.

Then, since the toner is fixed as already described, the toner image is detached from the intermediate transfer member 5 almost perfectly in the transfer fixation domain C, therefore the toner will not remain on the intermediate transfer member 5 after transfer and fixation, and thus a stain on the toner image retainer 1 and an occurrence of offset phenomenon can be prevented.

In this invention, a forced cooling of the intermediate transfer member 5 or the toner image retainer 1 will not be prohibited.

Figure 5:
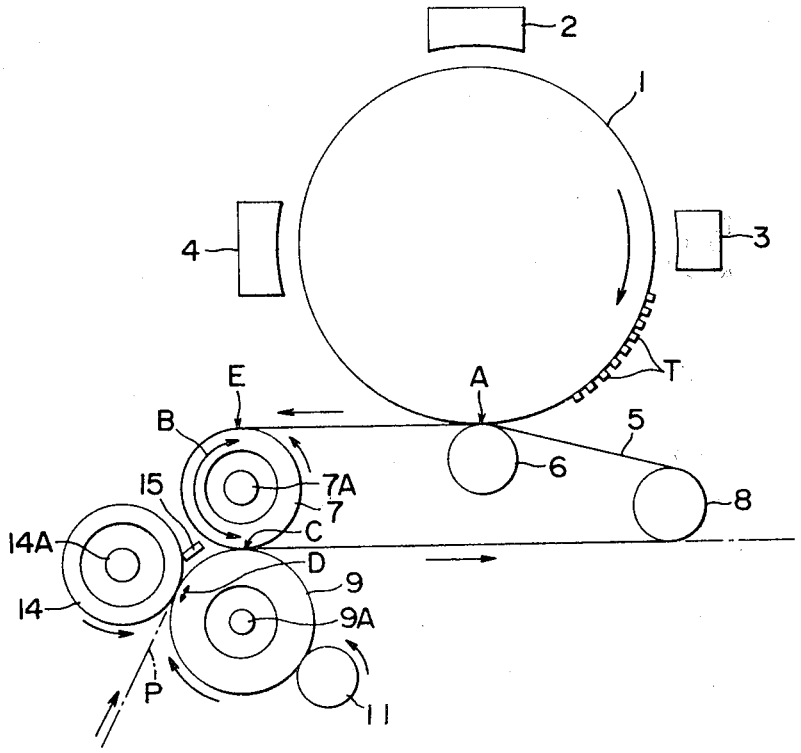
FIG. 5 is an explanatory drawing representing a constitution of the apparatus given in further example of this invention.
Figure 6:
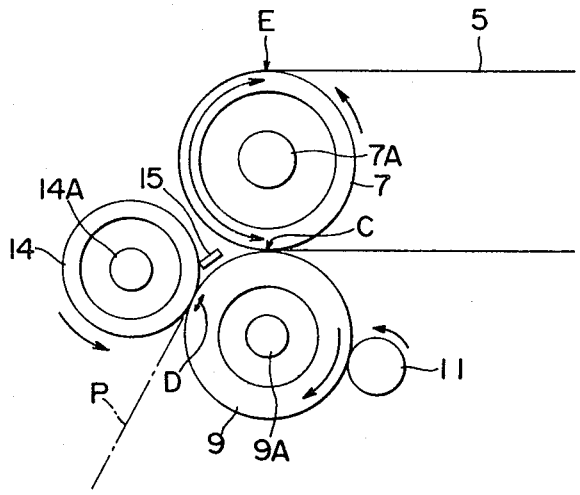
FIG. 6 is an enlarged view illustrating a part of FIG. 5.

FIG. 5 represents the third operative example of this invention, and the example is that in which a transfer material heating roller 14 having a heater 14A is provided against the heat pressure roller 9 instead of the transfer material heating plate 10 in the example of FIG. 1, and a transfer material guide plate 15 is provided further thereto. Then, as shown in FIG. 6, the transfer material is heated on the transfer material heating roller 14 when passing the transfer material heating domain D at the spot whereat the transfer material heating roller 14 and the heat pressure roller 9 come to press and then arrives at the transfer fixation domain C along the transfer material guide plate 15, and the toner image on the intermediate transfer member 5 is transferred and fixed onto the transfer material thereafter as in the example of FIG. 1. Different from the case of FIG. 1, the transfer material heating roller 14 gives a heat instantaneously to the transfer material. To prevent the toner from sticking on the surface of the transfer material heating roller 14, it is preferable that a mold releasability be given by coating or impregnation of resins such as polytetrafluoroethylene perfluoroalkoxide, or fluororesin of polyfluoroethylene propylene, or to remove the toner sticking thereon, a felt or blade can be provided.

Figure 7:
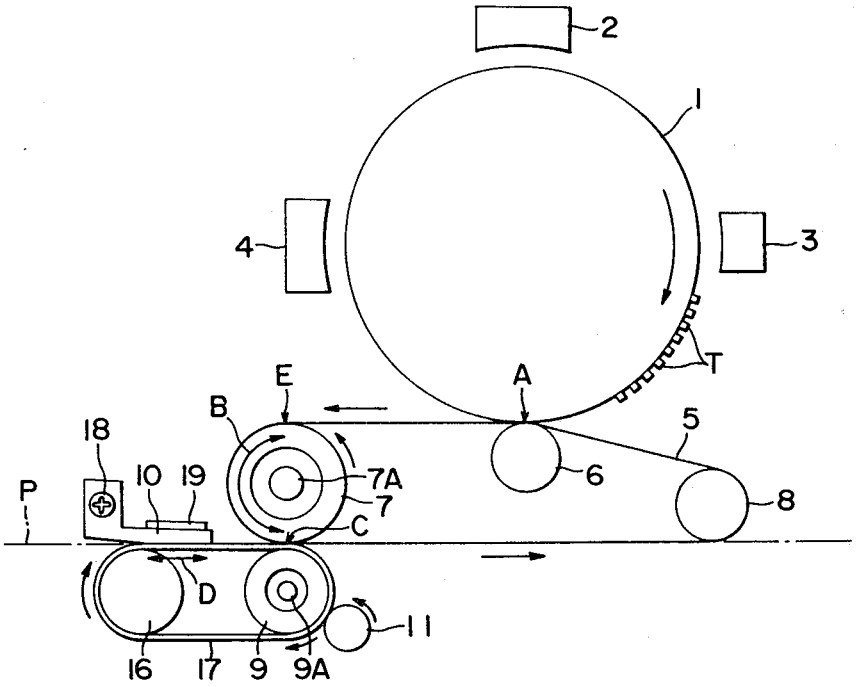
FIGS. 7 and 8 are explanatory drawings representing a constitution of the apparatus given in further example of this invention.

FIG. 7 represents the fourth operative example of the invention, and the example is that in which an endless belt 17 is laid on the heat pressure roller 9 and the tension roller 16, a rectilinear propagation zone of the endless belt 17 is arranged along the transfer material moving passage p, and the transfer material heating plate 10 is provided to come in contact therewith, which is pivoted rotatably at a bearing part 18. A numeral 19 denotes a heater. According to such constitution, the time in which the transfer material heating plate 10 and the transfer material are kept in contact with each other can be prolonged arbitrarily, and the transfer material can be heated accurately as moving at high speed. Further, the transfer material can be carried securely to a high reliability, and the transfer material heating plate 10 can be flat-shaped to facilitate manufacture.

An elastic body which is heat resisting like silicone rubber, polyimide, polyimideamide, etc. is preferable for material of the endless belt 17, and the thickness will come in 0.1–5 mm, for example, or 0.5–3 mm particularly for silicone rubber. It is then preferable that a suitable surface treatment be applied, as already described, on the transfer material heating plate 10 to minimize the friction coefficient and also to give wear resistance and mold releasability at the same time. Then, grooves can be formed on the outer periphery of the heat pressure roller 9 and the tension roller 16 to improve a friction force of the endless belt 17, and the groove will be 0.1 mm or so deep preferably in this case. It is also preferable that the tension roller 16 be constitued of a crown roller with the central outside dia. taken large as compared with both ends to prevent the endless belt 17 from running one-sidedly.

Figure 8:
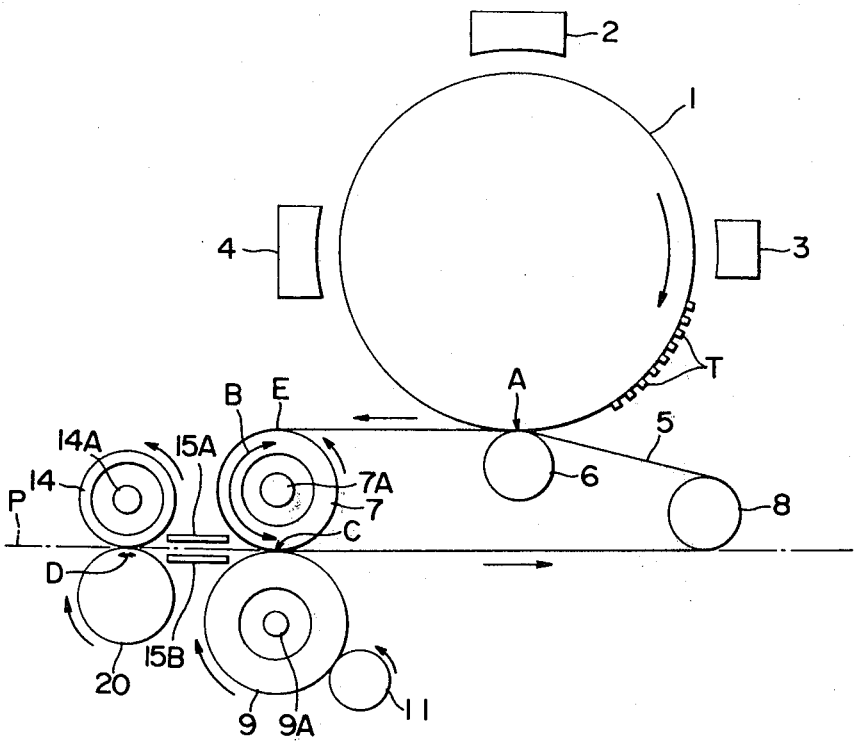

FIG. 8 represents the fifth operative example of this invention, and the example comprises a transfer material heating roller 14 and a roller 20 working together with it for the transfer material independently from the heat pressure roller 9 on the upstream side from the transfer fixation domain C in the transfer material moving passage p. According to the constitution, the transfer material is heated regardless of the heat pressure roller 9, thereforce the heat pressure roller 9 will not be heated excessively, the roller 20 is only to function for pressing the transfer material onto the transfer material heating roller 14, a heating efficiency of the transfer material heating roller 14 and a controlling precision on heating temperature of the transfer material can thus be improved, and an occurrence of offset phenomenon due to an excessive heating can be prevented consequently. Moreover, a heating of the transfer material is effected at a position apart from the heat pressure roller 9, and therefore the toner stuck to the heat pressure roller 9 can be prevented from sticking to the transfer material thermally. In the drawing, 15A and 15B denote transfer material guide plates.

The sixth operative example of this invention comprises, in the apparatus shown in FIG. 7, controlling the heater 9A properly for heat generation and heating a conveyance belt 17 in contact with the heat pressure roller 9 and the transfer material coming thereon to the toner fusion temperature or over. The conveyance belt 17 and the transfer material are therefore heated beforehand by the transfer material heating plate 10 to a temperature as high as possible but coming below the toner fusion temperature. When the transfer material and the conveyance belt 17 reach a position whereat they are pressed onto the intermediate transfer member 5 by the heat pressure roller 9, the temperature rises easily to the toner fusion temperature or over by a heat generated by the heater 9A.

From the above constitution, a contact length of the intermediate transfer member 5 and the transfer material in the transfer fixation domain C can be taken long in the forward direction of the transfer material, an interface of the transfer material and the intermediate transfer member 5 is heated to the toner fusion temperature or over through the conveyance belt 17 by the heat pressure roller 9, the toner image is fused at least at the side coming in contact with the transfer material and transferred and fixed onto the transfer material securely through a compression of the transfer material by the heat pressure roller 9.

In the sixth operative example, there is caused an abrupt temperature gradient within the intermediate transfer member 5 in the transfer fixation domain C by setting temperatures of the intermediate transfer member 5, the transfer material, the conveyance belt 17 and the heat pressure roller 9, therefore the surface of the intermediate transfer member 5 and at least a transfer material side of the toner image only stand at the fusion temperature or over, and when the intermediate transfer member 5 leaves the transier fixation domain C, the heat is diffused within the intermediate transfer member 5 to sweep off the temperature gradient in the intermediate transfer member 5, thus controlling the temperature of the intermediate transfer member 5 at a low level. A cooling of the intermediate transfer member 5 by the heat diffusion effect in the intermediate transfer member 5 is also effective to cool down the transfer material surface by contacting the transfer material after transfer and fixation with the intermediate transfer member 5, thereby improving an offset prevention effect furthermore.

Figure 2C:
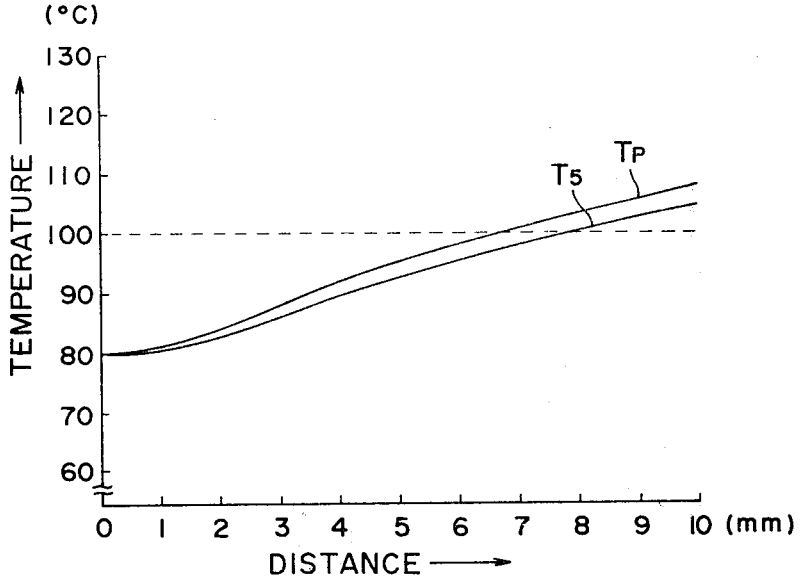
Figure 3C:
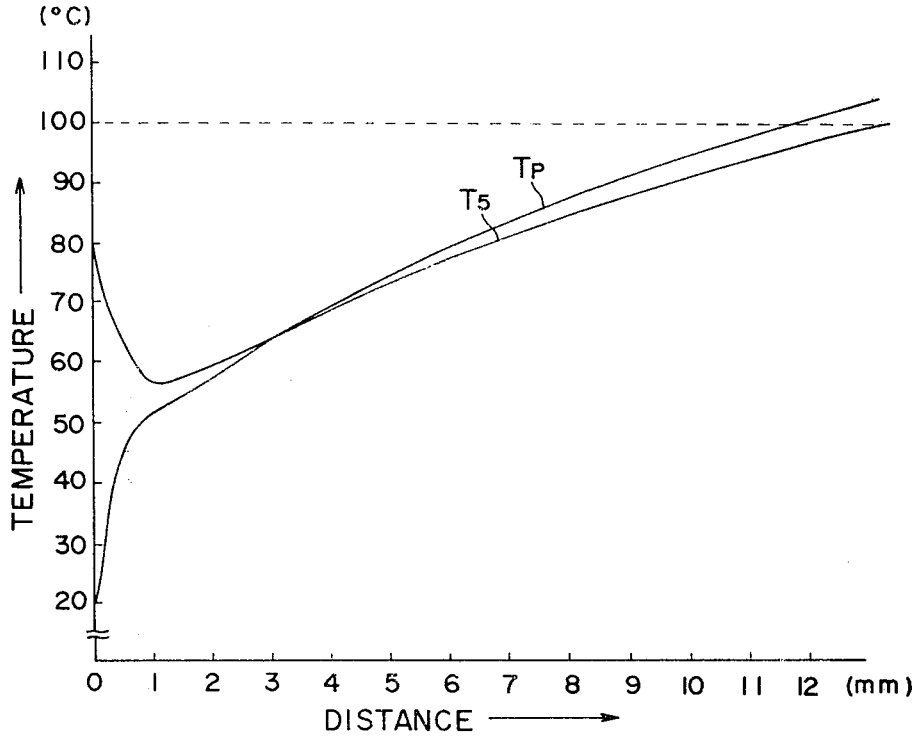

The state in which the surface temperature of the intermediate transfer member 5 having the toner image and the surface temperature of the transfer material change in the neighborhood of the transfer fixation domain in the apparatus given in FIG. 7 is shown in FIGS. 2C and 3C. In the drawings, $T_5$ denotes a surface temperature of the intermediate transfer member 5 and $T_P$ denotes a transfer surface temperature of the transfer material. Then, the quadrature axis indicates the position taken in the forward direction of the transfer material from the point 0 somewhat before a spot whereat the heat pressure roller 9 presses the transfer material onto the intermediate transfer member 5 through the conveyance belt 17.

Then, FIG. 2C represents the case wherein the transfer material is heated at 80° C. by the transfer material heating plate 10, FIG. 3C represents the case wherein the transfer material heating plate 10 is not used, and in either case the toner uses that of 100° C. in fusion temperature and the surface temperature of the heat pressure roller 9 is controlled at 200° C.

In both cases of FIGS. 2C and 3C, the surface temperature $T_5$ of the intermediate transfer member 5 and the transfer surface temperature of the transfer material can be brought at the toner fusion temperature or over by taking the transfer fixation domain C longer than in a conventional apparatus in the forward direction of the transfer material, and the toner image can be transferred and fixed perfectly onto the transfer material. The surface temperature rise of the intermediate transfer member 5 is limited to the surface as already described, which is cooled quickly down to the toner fusion temperature or below upon leaving the transfer fixation domain C.

Next, operative examples of this invention will be described as follows:

Example 1

The working toner used that of 100° C. in fusion temperature. For the intermediate transfer member, a belt intermediate transfer member obtained through applying silicone elastomer RTV-KE 1300 manufactured by Shin-etsu Chemical Industry Co., Ltd. which was dissolved in toluene to a belt polyimide substrate 50 μm to the thickness 50 μm by spray was used. A primary picture image on a photosensitive member was transferred onto the intermediate transfer member at a transfer zone, a rubber roll with an aluminum roll 50 dia. 2 mm thick coated with a silicone rubber 2 mm thick was provided inside the intermediate transfer member, and a toner image on the intermediate transfer member was heated at 80° C. together with the intermediate transfer member by a supporting roll and a halogen lamp heater provided within the supporting roll. For a heat pressure roller, that for which an aluminum roll 50 dia. 2 mm thick was coated with a silicone rubber 1 mm thick was used, which was heated at 200° C. by a halogen lamp heater provided therein and pressed onto the intermediate transfer member to constitute a transfer fixation zone. From passing a transfer paper heated at 120° C. on a heating plate in which a surface heating member with a membrance nichrome heating member embedded within a silicone rubber plate was bonded to an aluminum plate to the transfer fixation zone at a feeding rate of 150 mm/min., a final picture could be obtained which was superior in fixability under unfavorable conditions of high temperature and high moisture, free from bleeding or bulging in characters and lines and also fine in reproducibility of black daub and photo to a half tone.

Example 2

The working toner used that of 100° C. in fusion temperature. For the intermediate transfer member, a roll intermediate transfer member obtained through applying silicone elastomer RTV-KE 1300 manufactured by Shin-etsu Chemical Industry Co., Ltd. which was dissolved in toluene to the surface of a rubber roll with SVS roller 2 mm thick and 50 dia. coated with a silicone rubber 2 mm thick on the surface to the thickness 100 μm by spray was used. A primary picture image on a photosensitive member was transferred onto the intermediate transfer member at a transfer zone, and the toner image was heated at 80° C. together with the intermediate transfer member on a halogen lamp heater provided within the intermediate transfer member. For the heat pressure roller, a rubber roll for which an aluminum roll 50 dia. 2 mm thick was coated with a silicone rubber 1 mm thick was used. A transfer fixation zone was constituted of the intermediate transfer member and the heat pressure roller. The heat pressure roller was heated at 200° C. on a halogen lamp heater provided therein. From passing a transfer paper heated at 120° C. on a heating plate in which a surface heating member with a membrance nichrome heating member embedded within a silicone rubber plate was bonded to an aluminum plate to the transfer fixation zone at a feeding rate of 150 mm/min., a final picture could be obtained which was superior in fixability under unfavorable conditions of high temperature and high moisture, free from bleeding or bulging in characters and lines and also fine in reproducibility of black daub and photo to a half tone.

Example 3

The working toner used that of 115° C. in fusion temperature. For the intermediate transfer member, a belt intermediate transfer member obtained through applying silicone elastomer RTV-KE 1300 manufactured by Shin-etsu Chemical Industry Co., Ltd. which was dissolved in toluene to a belt polyimide substrate 50 μm to the thickness 50 μm by spray was used. A primary picture image on a photosensitive member was transferred onto the intermediate transfer member at a transfer zone, a rubber roll with an aluminum roll 50 dia. 2 mm thick coated with a silicone rubber 2 mm thick was provided inside the intermediate transfer member to work as a supporting roll, and a toner image on the intermediate transfer member was heated at 60° C. together with the intermediate transfer member on a halogen lamp heater provided within the supporting roll. For a heat pressure roller, that for which an aluminum roll 50 dia. 2 mm thick was coated with a silicone rubber 1 mm thick was used, which was heated at 80° C. by a halogen lamp heater provided therein and pressed onto the intermediate transfer member to constitute a transfer fixation zone. From passing a transfer paper heated at 160° C. on a heating plate in which a surface heating member with a membrance nichrome heating member embedded within a silicone rubber plate was bonded to an aluminum plate to the transfer fixation zone at a feeding rate of 150 mm/min., a final picture could be obtained which was superior in fixability under unfavorable conditions of high temperature and high moisture, free from bleeding or bulging in characters and lines and also fine in reproducibility of black daub and photo to a half tone.

Example 4

The working toner used that of 115° C. in fusion temperature. For the intermediate transfer member, a roll intermediate transfer member obtained through applying silicone elastomer RTV-KE 1300 manufactured by Shin-etsu Chemical Industry Co., Ltd. which was dissolved in toluene to the surface of a rubber roll with SVS roller 2 mm thick and 50 dia. coated with a silicone rubber 2 mm thick on the surface to the thickness 100 μm by spray was used. A primary picture image on a photosensitive member was transferred onto the intermediate transfer member at a transfer zone, and the toner image was heated at 60° C. together with the intermediate transfer member on a halogen lamp heater provided within the intermediate transfer member. For the heat pressure roller, a rubber roll for which an aluminum roll 50 dia. 2 mm thick was coated with a silicone rubber 1 mm thick was used. A transfer fixation zone was constituted of the intermediate transfer member and the heat pressure roller. The heat pressure roller was heated at 80° C. on a halogen lamp heater provided therein. From passing a transfer paper heated at 160° C. on a heating plate in which a surface heating member with a membrance nichrome heating member embedded within a silicone rubber plate was bonded to an aluminum plate to the transfer fixation zone at a feeding rate of 150 mm/min., a final picture could be obtained which was superior in fixability under unfavorable conditions of high temperature and high moisture, free from bleeding or bulging in characters and lines and also fine in reproducibility of black daub and photo to a half tone.

Example 5

The working toner used that of 115° C. in fusion temperature. For the intermediate transfer member, a belt intermediate transfer member obtained through applying silicone elastomer RTV-KE 1300 manufactured by Shin-etsu Chemical Industry Co., Ltd. which was dissolved in toluene to a belt polyimide substrate 50 μm to the thickness 50 μm by spray was used. A primary picture image on a photosensitive member was transferred onto the intermediate transfer member at a transfer zone, a rubber roll with an aluminum roll 50 dia. 2 mm thick coated with a silicone rubber 2 mm thick was provided inside the intermediate transfer member to work as a supporting roll, and a toner image on the intermediate transfer member was heated at 80° C. together with the intermediate transfer member on a halogen lamp heater provided within the supporting roll. For a heat pressure roller, that for which an aluminum roll 50 dia. 2 mm thick was coated with a silicone rubber 1 mm thick was used, which was heated at 200° C. by a halogen lamp heater provided therein and pressed onto the intermediate transfer member to constitute a transfer fixation zone. From passing a transfer paper heated at 60° C. on a heating plate in which a surface heating member with a membrance nichrome heating member embedded within a silicone rubber plate was bonded to an aluminum plate to the transfer fixation zone at a feeding rate of 150 mm/min., a final picture could be obtained which was superior in fixability under unfavorable conditions of high temperature and high moisture, free from bleeding or bulging in characters and lines and also fine in reproducibility of black daub and photo to a half tone.

Example 6

The working toner used that of 115° C. in fusion temperature. For the intermediate transfer member, a roll intermediate transfer member obtained through applying silicone elastomer RTV-KE 1300 manufactured by Shin-etsu Chemical Industry Co., Ltd. which was dissolved in toluene to the surface of a rubber roll with SVS roller 2 mm thick and 50 dia. coated with a silicone rubber 2 mm thick on the surface to the thickness 100 μm by spray was used. A primary picture image on a photosensitive member was transferred onto the intermediate transfer member at a transfer zone, and the toner image was heated at 80° C. together with the intermediate transfer member on a halogen lamp heater provided within the intermediate transfer member. For the heat pressure roller, a rubber roll for which an aluminum roll 50 dia. 2 mm thick was coated with a silicone rubber 1 mm thick was used. A transfer fixation zone was constituted of the intermediate transfer member and the heat pressure roller. The heat pressure roller was heated at 200° C. on a halogen lamp heater provided therein. From passing a transfer paper heated at 80° C. on a heating plate in which a surface heating member with a membrance nichrome heating member embedded within a silicone rubber plate was bonded to an aluminum plate to the transfer fixation zone at a feeding rate of 150 mm/min., a final picture could be obtained which was superior in fixability under unfavorable conditions of high temperature and high moisture, free from bleeding or bulging in characters and lines and also fine in reproducibility of black daub and photo to a half tone.

Then, in the first operative example of this invention, it is one of the requirements that the intermediate transfer member will be retained at a temperature lower than the toner fusion temperature and hence the intermediate transfer member is heated preferably 1°–40° C. lower than the toner fusion temperature.

Then, the pressure rollers are heated preferably 0°–150° C. higher and the transfer material 0°–30° C. higher.

Further, in the second operative example of this invention, it is one of the requirements that the intermediate transfer member will be retained at a temperature also lower than the toner fusion temperature and hence the intermediate transfer member is heated preferably 1°–60° C. lower than the toner fusion temperature. It is desirable that the pressure rollers be heated 1°–40° C. lower and the transfer material 0°–60° C. higher.

In the sixth operative example of the invention, one of the requirements is that the intermediate transfer member be retained at a temperature lower than the toner fusion temperature, therefore the intermediate transfer member can be fed into the position for transfer and fixation without heating, however, it will be heated preferably before it is fed thereinto. In this case, a good result has been obtained through heating it to a temperature 1°–70° C. lower than the toner fusion temperature before feeding. The transfer material can be fed into the position for transfer and fixation without heating likewise, however, it will be heated preferably at a temperature 1°–70° C. lower than that.

A description has been given of operative examples of the invention as above, however, the invention is not necessarily limited thereto, and, for example, the heater 9A may be avoided for installation on the heat pressure roller. In such a case, the temperature of the heat pressure roller 9 rises to a suitable temperature lower than the toner temperature under a balanced state by a heat from the heat roller 7 to heat the intermediate transfer member 5 and the transfer material heating plate 10, thereby attaining an object of this invention.

According to this invention, the toner image on the intermediate transfer member 5 can be transferred and fixed securely and suitably onto the transfer material as keeping a high resolution, the toner on the toner image retainer is pressed and so transferred onto the intermediate transfer member 5, a latent image on the toner image retainer 1 will not be destroyed fundamentally in consequence, therefore the same clear toner image can be formed by redeveloping the latent image, thus realizing the retention system securely.

What is claimed is:

1. In a method for transferring and fixing toner image wherein a toner image is transferred to an intermediate transfer member from a toner image retainer and then transferred and fixed onto a transfer material from the intermediate transfer member, the improvement characterized in that the toner image on the intermediate transfer member is heated at a temperature lower than the toner fusion temperature, a unit to press the transfer material onto the intermediate transfer member is heated to the toner fusion temperature or over, and the transfer material heated to the toner fusion temperature or over is then fed into a position for transfer and fixation, thereby transferring and fixing the toner image onto the transfer material.

2. In an apparatus for transferring and fixing toner image wherein a toner image is transferred to an intermediate transfer member from a toner image retainer and then retransferred and fixed onto a transfer material from the intermediate transfer member, the improvement comprising means to heat the toner image on the intermediate transfer member to a temperature lower than the toner fusion temperature, heating means to heat a pressing unit to press the transfer material onto the intermediate transfer member at the toner fusion temperature or over and heating means to heat the transfer material at the toner fusion temprerature or over, thereby feeding the transfer material into a position for transfer and fixation.

3. In a method for transferring and fixing toner image wherein a toner image is transferred to an intermediate transfer member from a toner image retainer and then transferred and fixed onto a transfer material from the intermediate transfer member, the improvement characterized in that the toner image on the intermediate transfer member is heated at a temperature lower than the toner fusion temperature, a unit to press the transfer material onto the intermediate transfer member is heated to the toner fusion temperature or below, and the transfer material heated to the toner fusion temperature or over is then fed into a position for transfer and fixation, thereby transferring and fixing the toner image onto the transfer material.

4. In an apparatus for transferring and fixing toner image whereby a toner image is transferred to an intermediate transfer member from a toner image retainer and then retransferred and fixed onto a transfer material from the intermediate transfer member, the improvement comprising means to heat the toner image on the intermediate transfer member to a temperature lower than the toner fusion temperature, heating means to heat a pressing unit to press the transfer material onto the intermediate transfer member at the toner fusion temperature or below, and means to heat the transfer material at the toner fusion temperature or over before pressing it onto the intermediate transfer member.

5. In a method for transferring and fixing toner image wherein a toner image is transferred to an intermediate transfer member from a toner image retainer and then transferred and fixed onto a transfer material from the intermediate transfer member, the improvement characterized in that the transfer material kept at a temperature lower than the toner fusion temperature is pressed onto the toner image on the intermediate transfer member with a press unit heated at a temperature higher than the toner fusion temperature, thereby transferring and fixing the toner image onto the transfer material.

6. In an apparatus for transferring and fixing toner image wherein a toner image is transferred to an intermediate transfer member from a toner image retainer and then retransferred and fixed onto a transfer material from the intermediate transfer member, the improvement characterized in that an intermediate transfer member at a temperature lower than the toner fusion temperature and a hot press unit heated at the toner fusion temperature or over which presses the transfer material onto the intermediate transfer member are provided, said transfer material is fed into a position whereat it is pressed onto the intermediate transfer member at a temperature lower than the toner fusion temperature.

7. The apparatus for transferring and fixing toner image as defined in claim 6, wherein said intermediate transfer member is heated and so retained at a temperature lower than the toner fusion temperature.

8. The apparatus for transferring and fixing toner image as defined in claim 2, wherein the toner image retainer and the intermediate transfer member are roll or belt turning bodies each.

9. The apparatus for transferring and fixing toner image as defined in claim 2, wherein the upper surface of the intermediate transfer member consists of a silicone rubber or fluororubber.

10. The apparatus for transferring and fixing toner image as defined in claim 7, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

11. The apparatus for transferring and fixing toner image as defined in claim 10, wherein the intermediate transfer member is a belt turning body, and a pressure roller to press the intermediate transfer member onto the toner image retainer is provided on the lower side of the intermediate transfer member separately from said heat roller.

12. The apparatus for transferring and fixing toner image as defined in claim 4, wherein the toner image retainer and the intermediate transfer member are roll or belt turning bodies each.

13. The apparatus for transferring and fixing toner image as defined in claim 6, wherein the toner image retainer and the intermediate transfer member are roll or belt turning bodies each.

14. The apparatus for transferring and fixing toner image as defined in claim 7, wherein the toner image retainer and the intermediate transfer member are roll or belt turning bodies each.

15. The apparatus for transferring and fixing toner image as defined in claim 4, wherein the upper surface of the intermediate transfer member consists of a silicone rubber or fluororubber.

16. The apparatus for transferring and fixing toner image as defined in claim 6, wherein the upper surface of the intermediate transfer member consists of a silicone rubber or fluororubber.

17. The apparatus for transferring and fixing toner image as defined in claim 7, wherein the upper surface of the intermediate transfer member consists of a silicone rubber or fluororubber.

18. The apparatus for transferring and fixing toner image as defined in claim 8, wherein the upper surface of the intermediate transfer member consists of a silicone rubber or fluororubber.

19. The apparatus for transferring and fixing toner image as defined in claim 12, wherein the upper surface of the intermediate transfer member consists of a silicone rubber or fluororubber.

20. The apparatus for transferring and fixing toner image as defined in claim 13, wherein the upper surface of the intermediate transfer member consists of a silicone rubber or fluororubber.

21. The apparatus for transferring and fixing toner image as defined in claim 14, wherein the upper surface of the intermediate transfer member consists of a silicone rubber or fluororubber.

22. The apparatus for transferring and fixing toner image as defined in claim 8, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

23. The apparatus for transferring and fixing toner image as defined in claim 9, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

24. The apparatus for transferring and fixing toner image as defined in claim 12, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

25. The apparatus for transferring and fixing toner image as defined in claim 13, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

26. The apparatus for transferring and fixing toner image as defined in claim 14, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

27. The apparatus for transferring and fixing toner image as defined in claim 15, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

28. The apparatus for transferring and fixing toner image as defined in claim 16, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

29. The apparatus for transferring and fixing toner image as defined in claim 17, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

30. The apparatus for transferring and fixing toner image as defined in claim 18, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

31. The apparatus for transferring and fixing toner image as defined in claim 19, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

32. The apparatus for transferring and fixing toner image as defined in claim 20, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

33. The apparatus for transferring and fixing toner image as defined in claim 21, wherein the heating means for the intermediate transfer member is a heat roller in contact with the lower side of the intermediate transfer member to turn the intermediate transfer member, and the hot press unit is a heat pressure roller to press and feed the intermediate transfer member and the transfer material with said heat roller.

34. The apparatus for transferring and fixing toner image as defined in claim 22, wherein the intermediate transfer member is a belt turning body, and a pressure roller to press the intermediate transfer member onto the toner image retainer is provided on the lower side of the intermediate transfer member separately from said heat roller.

35. The apparatus for transferring and fixing toner image as defined in claim 23, wherein the intermediate transfer member is a belt turning body, and a pressure roller to press the intermediate transfer member onto the toner image retainer is provided on the lower side of the intermediate transfer member separately from said heat roller.

36. The apparatus for transferring and fixing toner image as defined in claim 24, wherein the intermediate transfer member is a belt turning body, and a pressure roller to press the intermediate transfer member onto the toner image retainer is provided on the lower side of the intermediate transfer member separately from said heat roller.

37. The apparatus for transferring and fixing toner image as defined in claim 25, wherein the intermediate transfer member is a belt turning body, and a pressure roller to press the intermediate transfer member onto the toner image retainer is provided on the lower side of the intermediate transfer member separately from said heat roller.

38. The apparatus for transferring and fixing toner image as defined in claim 26, wherein the intermediate transfer member is a belt turning body, and a pressure roller to press the intermediate transfer member onto the toner image retainer is provided on the lower side of the intermediate transfer member separately from said heat roller.

39. The apparatus for transferring and fixing toner image as defined in claim 27, wherein the intermediate transfer member is a belt turning body, and a pressure roller to press the intermediate transfer member onto the toner image retainer is provided on the lower side of the intermediate transfer member separately from said heat roller.

40. The apparatus for transferring and fixing toner image as defined in claim 28, wherein the intermediate transfer member is a belt turning body, and a pressure roller to press the intermediate transfer member onto the toner image retainer is provided on the lower side of the intermediate transfer member separately from said heat roller.

41. The apparatus for transferring and fixing toner image as defined in claim 29, wherein the intermediate transfer member is a belt turning body, and a pressure roller to press the intermediate transfer member onto the toner image retainer is provided on the lower side of the intermediate transfer member separately from said heat roller.

42. The apparatus for transferring and fixing toner image as defined in claim 30, wherein the intermediate transfer member is a belt turning body, and a pressure roller to press the intermediate transfer member onto the toner image retainer is provided on the lower side of the intermediate transfer member separately from said heat roller.

43. The apparatus for transferring and fixing toner image as defined in claim 31, wherein the intermediate transfer member is a belt turning body, and a pressure roller to press the intermediate transfer member onto the toner image retainer is provided on the lower side of the intermediate transfer member separately from said heat roller.

44. The apparatus for transferring and fixing toner image as defined in claim 32, wherein the intermediate transfer member is a belt turning body, and a pressure roller to press the intermediate transfer member onto the toner image retainer is provided on the lower side of the intermediate transfer member separately from said heat roller.

45. The apparatus for transferring and fixing toner image as defined in claim 33, wherein the intermediate transfer member is a belt turning body, and a pressure roller to press the intermediate transfer member onto the toner image retainer is provided on the lower side of the intermediate transfer member separately from said heat roller.

* * * * *